US010369591B2

(12) United States Patent
Byrne

(10) Patent No.: US 10,369,591 B2
(45) Date of Patent: Aug. 6, 2019

(54) PIPE PAINTER ASSEMBLY

(71) Applicant: The Wooster Brush Company, Wooster, OH (US)

(72) Inventor: James M. Byrne, Wooster, OH (US)

(73) Assignee: THE WOOSTER BRUSH COMPANY, Wooster, OH (US)

( * ) Notice: Subject to any disclaimer, the term of this patent is extended or adjusted under 35 U.S.C. 154(b) by 710 days.

(21) Appl. No.: 14/461,715

(22) Filed: Aug. 18, 2014

(65) Prior Publication Data

US 2015/0052699 A1 Feb. 26, 2015

Related U.S. Application Data

(60) Provisional application No. 61/868,188, filed on Aug. 21, 2013.

(51) Int. Cl.
*B05C 17/02* (2006.01)

(52) U.S. Cl.
CPC ..... *B05C 17/0212* (2013.01); *B05C 17/0227* (2013.01)

(58) Field of Classification Search
CPC ..... B05C 17/01212; B05C 17/0227; B05C 17/02; B05C 17/022
USPC ..... 15/230.11, 143.1; 492/13
See application file for complete search history.

(56) References Cited

U.S. PATENT DOCUMENTS 2,799,884 A * 7/1957 Bedford ..... B05C 17/0227 15/118
2,813,292 A 11/1957 McLendon
2,824,328 A 2/1958 Bedford
2,881,461 A 4/1959 Parker
3,450,140 A * 6/1969 Vail ..... A45D 19/02 132/212
4,335,484 A 6/1982 Ridge et al.
4,644,604 A 2/1987 Kierce
5,035,022 A 7/1991 Iuliano et al.
5,903,952 A * 5/1999 Camp, Jr. ..... B05C 17/022 15/144.1
6,000,090 A 12/1999 Sutherland
6,219,877 B1 4/2001 Lowrey et al.
6,957,470 B2 10/2005 Rivadeneira
(Continued)

FOREIGN PATENT DOCUMENTS

DE 2823277 5/1978
DE 3616114 5/1986
FR 1427399 3/1965

*Primary Examiner* — Sean K. Hunter
*Assistant Examiner* — Stephanie R Berry
(74) *Attorney, Agent, or Firm* — Renner, Otto, Boisselle & Sklar, LLP

(57) ABSTRACT

A pipe painter assembly comprises a handle and a pair of paint roller frames. The paint roller frames comprise respective shaft portions for rotatably supporting respective paint roller cover supports thereon and respective rod portions extending at an angle relative to the respective shaft portions. The handle has a pair of laterally spaced axially extending substantially parallel bores in which outer ends of the respective rod portions are selectively rotatably mounted, whereby turning of either or both of the respective rod portions in either direction in the respective bores will vary the angular orientation of the paint roller cover supports relative to one another for accommodating different size pipes or other articles between the roller cover supports.

17 Claims, 6 Drawing Sheets

(56) References Cited

U.S. PATENT DOCUMENTS

| | | | | |
|---|---|---|---|---|
| 7,281,291 | B1 | 10/2007 | Hajianpour | |
| 2007/0000083 | A1 | 1/2007 | Lanz et al. | |
| 2008/0086828 | A1 | 4/2008 | Major | |
| 2011/0099741 | A1 | 5/2011 | Gallardo | |
| 2012/0272470 | A1* | 11/2012 | Gallardo ..... | B05C 17/0207<br>15/230.11 |

* cited by examiner

PIPE PAINTER ASSEMBLY

CROSS-REFERENCE TO RELATED APPLICATION

This application claims the benefit of U.S. Provisional Application Ser. No. 61/868,188, filed Aug. 21, 2013, the entire disclosure of which is incorporated herein by reference.

FIELD OF THE INVENTION

This invention relates generally to a pipe painter assembly for applying paint or other coatings to different diameter pipes or other articles.

BACKGROUND

It is generally known to provide pipe painters comprising two or more paint roller covers that are adjustable relative to one another for accommodating different size pipes or other articles.

However, there is an ongoing need for a pipe painter assembly that is easily adjustable to accommodate a wide range of pipe diameters or other articles between a pair of paint roller covers to provide better surface coverage and to keep the roller covers in contact with the different diameter pipe or other articles during application of paint or other coatings (hereafter collectively "paint") thereto.

SUMMARY OF THE INVENTION

The present invention relates to a pipe painter assembly comprising two paint roller frames and associated roller covers that are attached to a common handle by mechanisms that allow either or both of the roller frames and associated roller covers to be incrementally adjusted relative to one another to vary the angular orientation between the roller covers for accommodating different size pipes or other articles therebetween.

In accordance with one aspect, the pipe painter assembly comprises a pair of paint roller frames each having respective shaft portions at one end for rotatably supporting a paint roller cover support thereon and respective rod portions at the other end that are angled with respect to the respective shaft portions and are rotatably mounted in a pair of laterally spaced substantially parallel bores in a common handle, whereby selective turning of one or both of the rod portions in the respective bores will vary the angular orientation of the respective shaft portions and associated roller cover supports relative to one another for accommodating different size pipes or other articles between the roller covers.

In accordance with another aspect, the respective bores in the handle may have a plurality of circumferentially spaced notches (or gear teeth) for selective engagement and disengagement with a plurality of circumferentially spaced gear teeth (or notches) on the respective rod portions of the roller frames for selective turning of the rod portions in the respective bores.

These and other objects, advantages, features and aspects of the present invention will become apparent as the following description proceeds.

DETAILED DESCRIPTION

Figure 1:
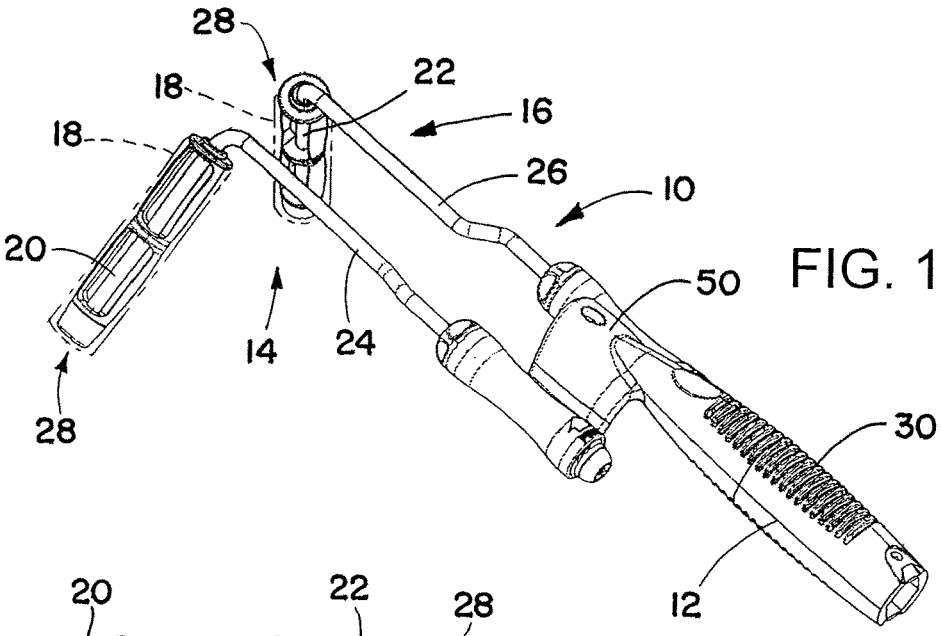
FIG. 1 is a perspective view of an exemplary pipe painter assembly of the present invention showing the respective roller covers angled relative to one another.
Figure 2:
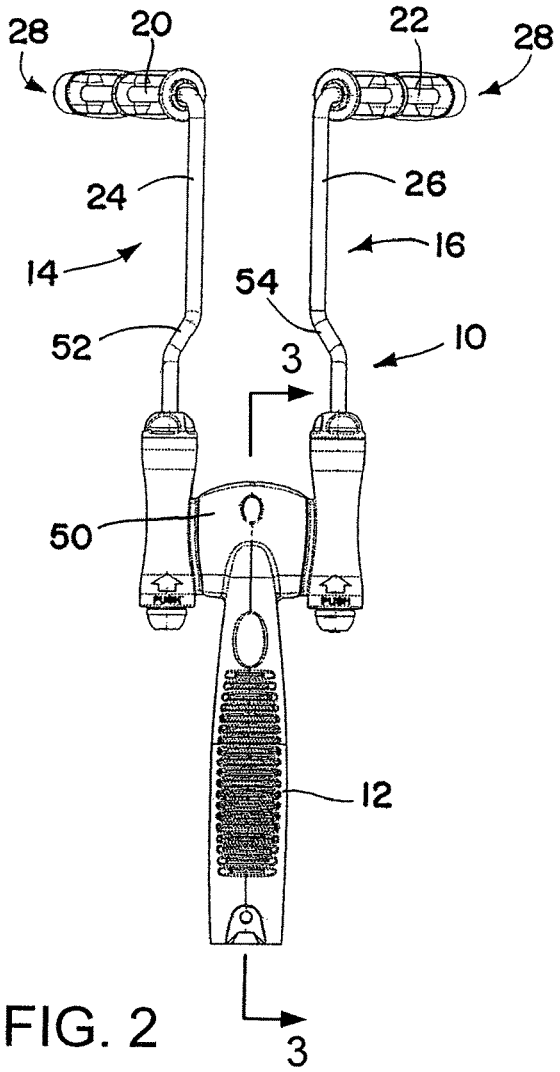
FIG. 2 is a top plan view of the pipe painter assembly of FIG. 1.
Figure 3:
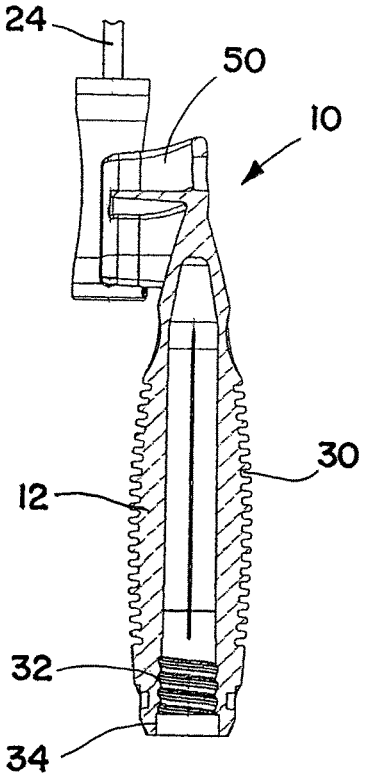
FIG. 3 is an enlarged fragmentary longitudinal section through the handle portion of the pipe painter assembly of FIG. 2, taken on the plane of the line 3-3 thereof.

Referring now in detail to the drawings, and initially to FIGS. 1-3, there is shown an exemplary embodiment of a pipe painter assembly 10 in accordance with this invention comprising a handle 12 and a pair of paint roller frames 14, 16. The roller frames are adjustably connected to the handle for allowing either or both of the roller frames to be incrementally adjusted to vary the angular orientation between paint roller covers 18 (shown in phantom lines throughout the drawings) supported thereby for accommodating different size pipes or other articles therebetween as described in greater detail hereafter.

Each of the paint roller frames 14, 16 may be made from a heavy gauge wire or rod bent to shape to provide respective shaft portions 20, 22 at one end for rotatably supporting a paint roller cover 18 thereon and respective rod portions 24, 26 at the other end for attachment to the handle 12 as described hereafter. The respective roller covers 18 may be supported on the respective shaft portions in any suitable manner, for example, by sliding the respective paint roller covers on respective cage assemblies 28 or other suitable roller cover supports on the respective shaft portions, as well known in the art.

In this example, the handle 12 includes a hand grip 30 adjacent the inner end containing a threaded socket 32 (see FIG. 3) to permit the handle to be threadedly attached to virtually any standard threaded extension pole tip (not shown). Also the threaded socket 32 may be provided with a larger diameter non-circular recess 34 adjacent its outer end for establishing an anti-rotation connection with a quick release lock mechanism for extension pole tips of the type disclosed, for example, in U.S. Pat. No. 5,288,161 assigned to the same assignee as the present invention, the entire disclosure of which is incorporated herein by reference.

Figure 5:
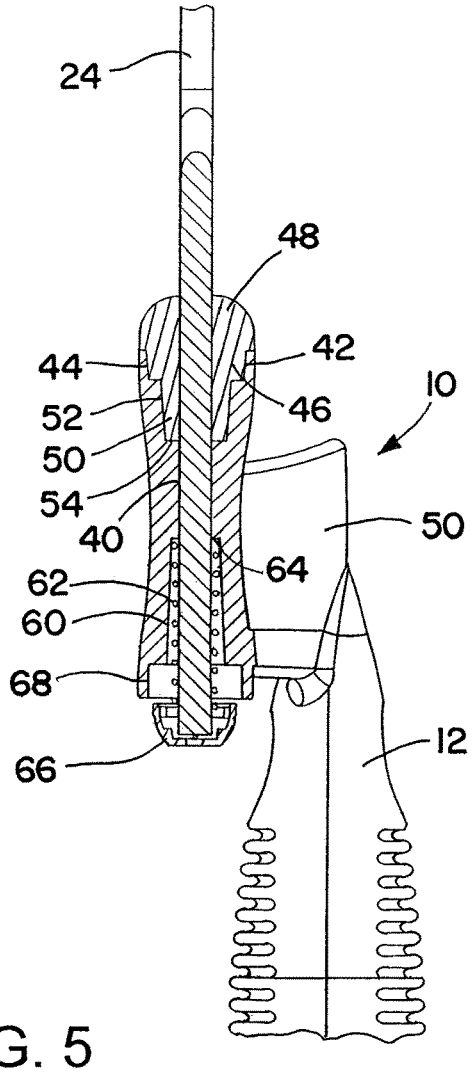
FIG. 5 is an enlarged fragmentary longitudinal section through one of the mechanisms of the pipe painter handle of FIG. 4 for releasably retaining the respective roller covers in any one of a plurality of angularly adjusted positions in the engaged position, taken on the plane of the line 5-5 thereof.
Figure 7:
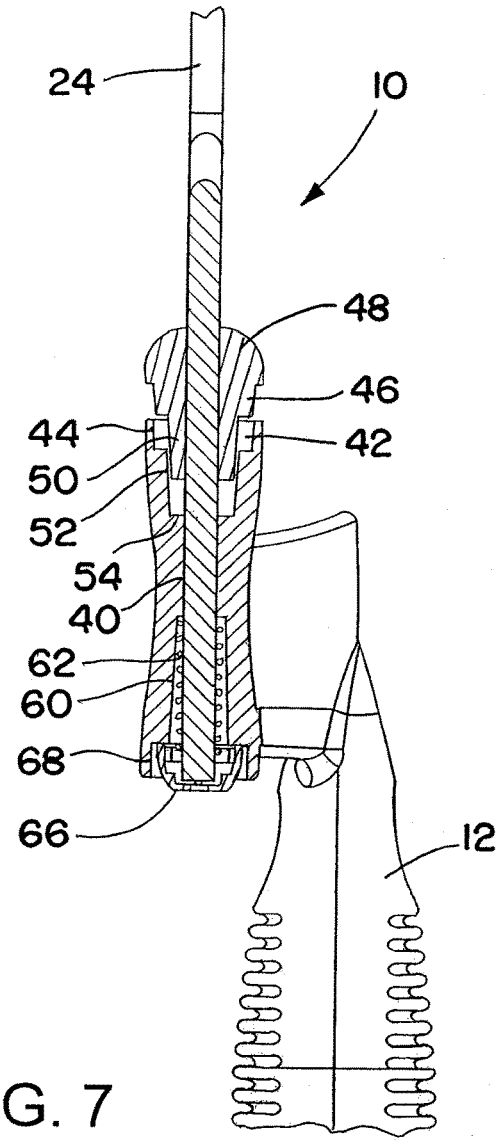
FIG. 7 is an enlarged fragmentary longitudinal section through one of the mechanisms of the pipe painter handle of FIG. 6 for releasably retaining the respective roller covers in any one of a plurality of angularly adjusted positions in the disengaged position, taken on the plane of the line 7-7 thereof.
Figure 8:
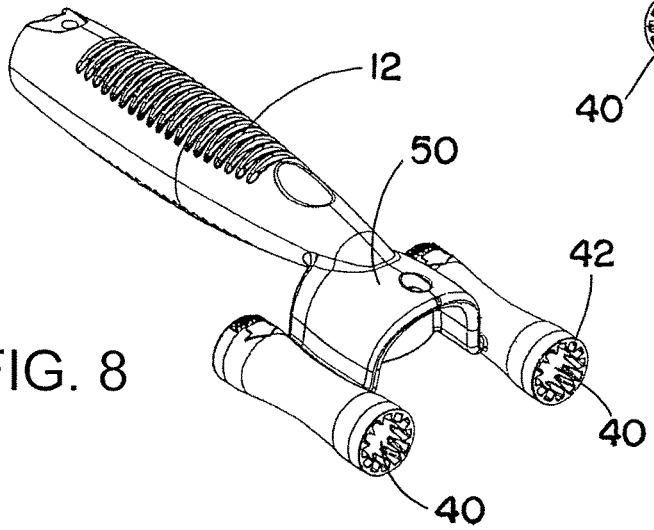
FIG. 8 is a front perspective view of the handle portion of the pipe painter assembly of FIG. 1.
Figure 9:
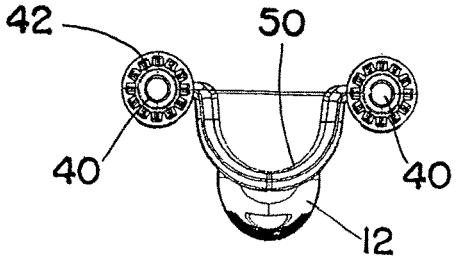
FIG. 9 is a front end elevation view of the handle portion of FIG. 8.
Figure 10A:
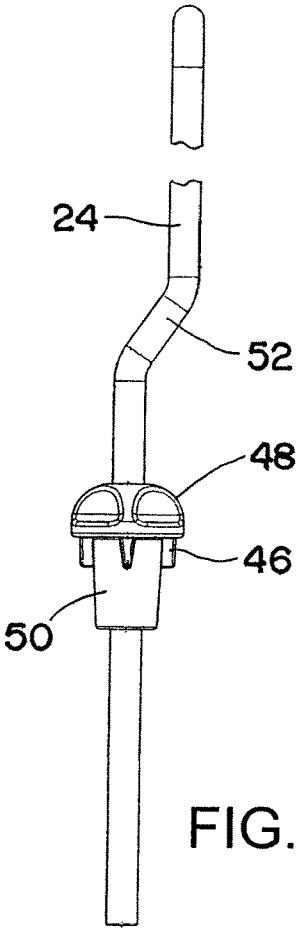
FIGS. 10A and 10B are enlarged fragmentary side elevation views of the rod portions and associated gear teeth of the respective paint roller frames of FIGS. 4 and 6.
Figure 10B:
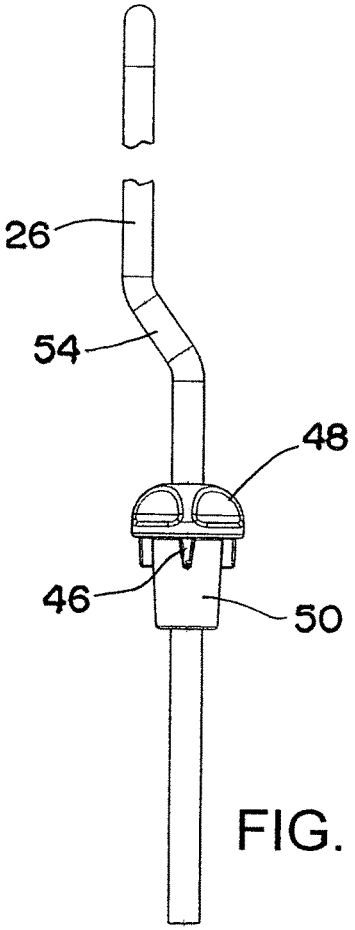

Adjacent the inner end of the handle 12 are a pair of laterally spaced substantially parallel bores 40 (both of which are shown in FIGS. 8 and 9 and one of which is shown in FIGS. 5 and 7) in which the outer ends of the respective rod portions 24, 26 are rotatably mounted, whereby turning of either or both of the rod portions in the respective bores will vary the angular orientation of the respective roller covers relative to one another for accommodating different size pipes or other articles between the roller covers as described in greater detail hereafter.

In this example, the outer ends of the rod portions 24, 26 are selectively retained in any one of a plurality of incremental angular adjusted positions in the respective bores 40 by providing a plurality of circumferentially spaced notches 42 in the inner wall of a first counterbore 44 at the inner end of the respective bores 40 and a plurality of circumferentially spaced gear teeth 46 on respective gear housings 48 molded or otherwise attached to the respective rod portions in axial spaced relation from the outer ends thereof that are selectively engageable with a corresponding number of the notches.

Also in this example, the respective gear housings 48 have inwardly tapered hub portions 50 for ease of axial sliding engagement of the hub portions within correspondingly tapered inner walls of the respective second counterbores 52 as shown in FIGS. 5, 7, 10A and 10B. Additionally, the gear teeth 46 and notches 42 may have correspondingly tapered sides (see FIGS. 8, 9, 10A and 10B) for ease of axial sliding movement of the teeth into and out of engagement with the respective notches. A stop shoulder 54 adjacent the inner end of the respective second counterbores 52 (see FIGS. 5 and 7) limit inward movement of the outer end of the rod portions 24, 26 within the respective bores. Alternatively, the gear teeth may be provided on the inner wall of the first counterbore and the notches may be provided in the outer wall of the hub portion of the respective gear housings if desired.

Figure 6:
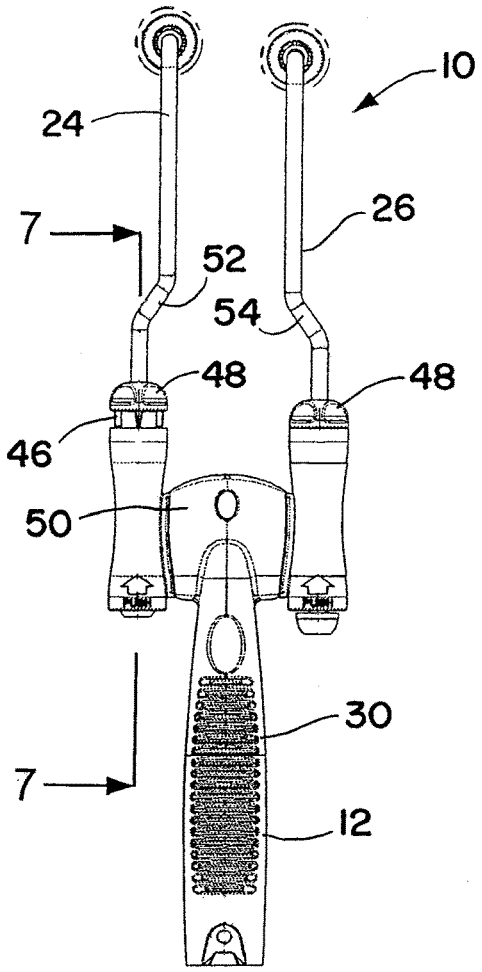
FIG. 6 is a top plan view similar to FIG. 4 but showing one of the rod portions disengaged from the handle portion for indexing movement of the associated roller cover to different angular orientations relative to the other roller cover.

Adjacent the outer end of the respective bores 40 is a third counterbore 60 containing a compression spring 62 through which the outer ends of the respective rod portions 24, 26 extend. The springs 62 are captivated between a shoulder 64 at the inner end of the second counterbore 60 and a pushnut 66 secured to the outermost end of the rod portions. A fourth counterbore 68 at the outer end of the third counterbore 60 receives the respective pushnuts 66, whereby pushing the respective pushnuts against the springs will disengage the gear teeth 46 from the respective notches 42 as shown in FIGS. 6 and 7 to permit the rod portions 24, 26 of either or both of the roller frames 14, 16 to be indexed to different positions relative to one another for varying the angular orientation of the roller covers 18 relative to one another.

Although the increments of angular adjustment of the roller covers relative to one another may be varied as desired, in this example, twelve circumferentially spaced notches 42 are provided in the inner wall of the first counterbore 44 that are selectively engageable by two or more appropriately circumferentially spaced gear teeth 46 on the gear housing 48 (four gear teeth being shown circumferentially spaced 90° from one another) upon selectively disengaging the gear teeth of either or both of the gear housings from the respective notches and turning either or both of the respective rod portions in either direction within the respective bores to the desired position to allow either or both of the roller covers to be indexed in 30° (or more) increments in either direction.

Figure 4:
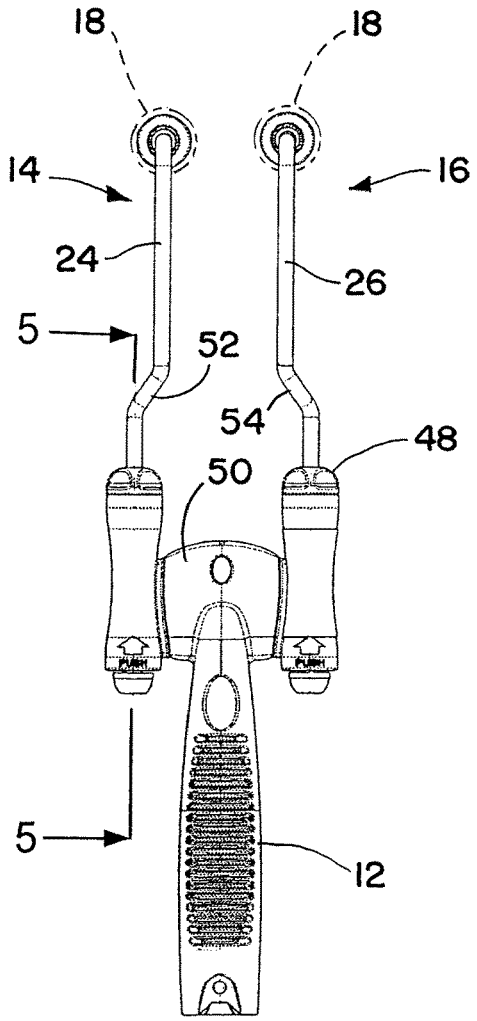
FIG. 4 is a top plan view of the pipe painter assembly of FIG. 1, but showing both of the respective roller covers in parallel relation to one another.
Figure 11A:
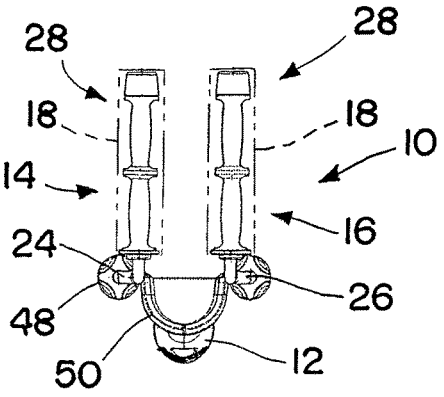
FIG. 11A is an end elevation view of the pipe painter assembly of FIG. 4 as seen from the end opposite the handle.

As seen for example in FIGS. 1, 4 and 11A, the shaft portions 20, 24 are substantially orthogonal to the respective rod portions 24, 26. Also the rod portions 24, 26 are of substantially the same length, whereby when the respective roller cover supports and associated roller covers when mounted thereon are in one of the various incremental adjusted positions shown in FIGS. 4 and 11A, the axes of the roller cover supports and associated roller covers are in the same plane in parallel alignment with one another to provide a minimum spacing between the roller covers for painting (or otherwise coating) opposite sides of relatively small diameter pipe or other articles including, but not limited to I beams or the like.

In this example, the minimum spacing between the roller cover supports and associated roller covers 18 when in parallel alignment with one another is dictated by the lateral spacing between the bores 40 which are located in opposite end portions of a cross member 50 extending laterally outwardly beyond opposite sides of the handle 12. Also the respective rod portions 24, 26 may have oppositely angled portions 52, 54 intermediate the respective gear housings 48 and shaft portions 20, 22 that extend inwardly (or outwardly) toward one another when the respective roller covers are in substantially parallel alignment with one another as shown in FIGS. 4, 6 and 11A to decrease (or increase) the minimum spacing between the roller covers when so oriented.

Figure 11B:
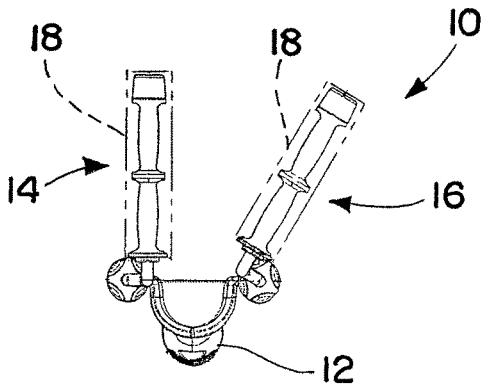
FIGS. 11B-11H are end elevation views of the pipe painter assembly similar to FIG. 11A but showing the respective roller frames and associated roller covers in different incremental angular adjusted positions relative to one another to accommodate different size pipes or other articles therebetween.
Figure 11C:
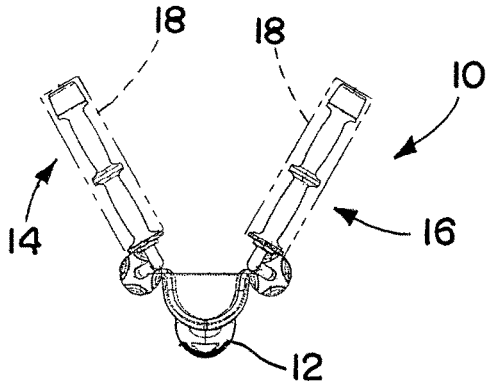
Figure 11D:
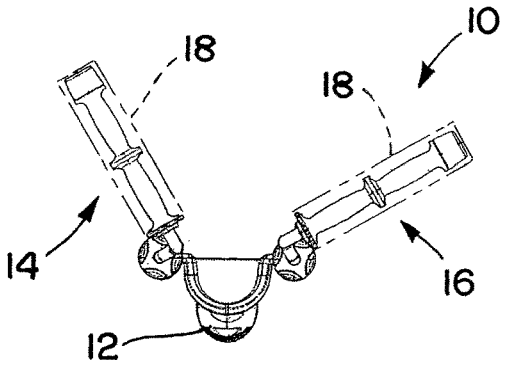
Figure 11E:
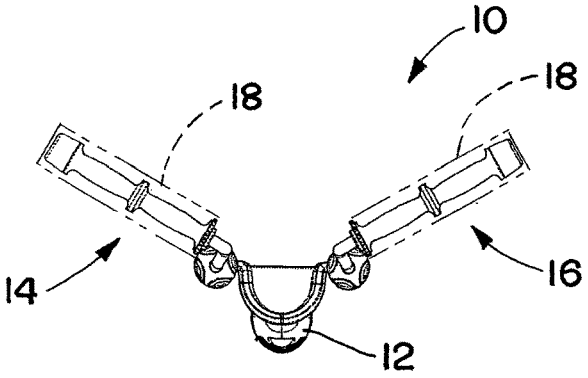
Figure 11F:
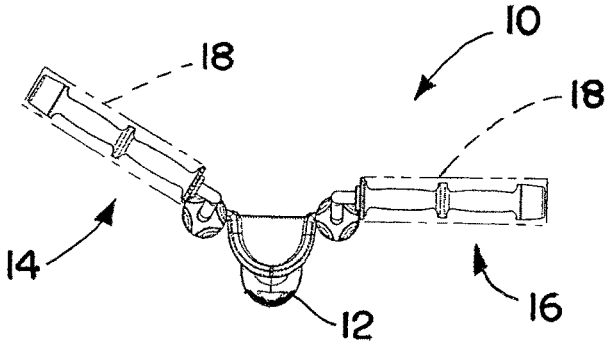
Figure 11G:
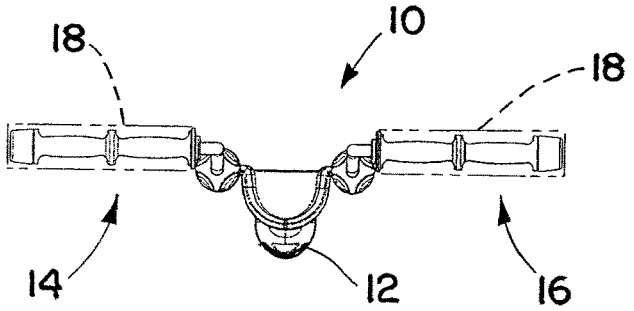
Figure 11H:
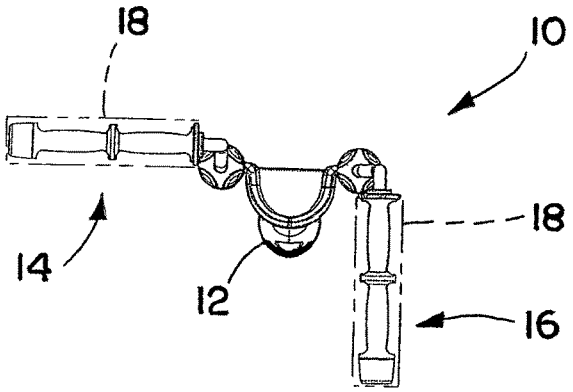

FIGS. 11A-11H show the two roller covers 18 oriented in various different incremental positions to accommodate different size pipes or other articles therebetween. FIG. 11A shows the two roller covers 18 in parallel alignment with one another with a minimum spacing therebetween for accommodating for example one inch pipe or I-beams or other articles therebetween; FIG. 11B shows one of the roller covers incrementally adjusted 30° relative to the other roller cover for accommodating for example one inch to two and one-half inch pipe therebetween; FIG. 11C shows the two roller covers incrementally adjusted 30° away from each other for accommodating for example two and one-half inch to five and one-half inch pipe therebetween; FIG. 11D shows one of the roller covers incrementally adjusted 30° in one direction and the other roller cover incrementally adjusted 60° in the opposite direction for accommodating for example five and one-half inch to ten inch pipe therebetween; FIG. 11E shows both of the roller covers incrementally adjusted 60° in opposite directions relative to one another for accommodating for example ten inch to sixteen inch pipe therebetween; FIG. 11F shows one of the roller covers incrementally adjusted 60° in one direction and the other roller cover incrementally adjusted 90° in the opposite direction for accommodating for example sixteen inch to thirty-six inch pipe therebetween; FIG. 11G shows both of the roller covers incrementally adjusted 90° in opposite directions relative to one another for accommodating for example one hundred forty-four or more inch pipe; and FIG. 11H shows one of the roller covers incrementally adjusted 90° in one direction and the other roller cover incrementally adjusted 180° in the opposite direction for accommodating large I beams or the like.

Although the invention has been shown and described with respect to a certain embodiment, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the exemplary embodiment. In addition, while a particular feature may have been disclosed with respect to only one embodiment, such feature may be combined with one or more other features as may be desired or advantageous for any given or particular application.

What is claimed is:

1. A pipe painter assembly comprising a handle and a pair of paint roller frames, the paint roller frames comprising respective shaft portions for rotatably supporting respective paint roller cover supports thereon and respective rod portions extending at an angle relative to the respective shaft portions for attaching the respective roller frames to the handle, and the handle having a pair of laterally spaced axially extending bores in substantially axially parallel fixed relation to one another in which outer ends of the respective rod portions are selectively mounted for rotation in opposite directions, wherein the bores remain in substantially axially parallel fixed relation to one another during such rotation of the rod portions in opposite directions, whereby turning of either or both of the respective rod portions in either direction in the respective bores will vary an angular orientation of the paint roller cover supports relative to one another for accommodating different size pipes or other articles between the roller cover supports.

2. The pipe painter assembly of claim 1 wherein inner ends of the respective bores in the handle contain first counterbores, and one of the respective counterbores and the respective rod portions has a plurality of circumferentially spaced notches, and the other of the respective counterbores and the respective rod portions has a plurality of circumferentially spaced gear teeth that are selectively engageable in a corresponding number of the notches for releasably retaining the rod portions in any one of a plurality of incremental angular adjusted positions in the respective bores.

3. The pipe painter assembly of claim 1 wherein inner ends of the respective bores in the handle contain first counterbores having a plurality of circumferentially spaced notches in an inner wall of the respective first counterbores, and the respective rod portions have a plurality of circumferentially spaced gear teeth mounted thereon in axial spaced relation from an outermost end of the rod portions that are selectively engageable in a corresponding number of the notches for releasably retaining the rod portions in any one of a plurality of incremental angular positions in the respective bores.

4. The pipe painter assembly of claim 2 wherein the gear teeth are part of gear housings molded or otherwise attached to the respective rod portions.

5. The pipe painter assembly of claim 2 further comprising spring means for biasing the gear teeth into engagement with the respective notches in the respective first counterbores.

6. The pipe painter assembly of claim 5 wherein the spring means is received in respective second counterbores adjacent outer ends of the respective bores, and outer ends of the respective rod portions extend through the respective spring means.

7. The pipe painter assembly of claim 6 wherein the spring means is captivated between a shoulder at an inner end of the respective second counterbores and a pushnut on an outermost end of the respective rod portions.

8. The pipe painter assembly of claim 7 further comprising respective third counterbores in an outer end of the respective second counterbores for receiving the respective pushnuts upon pushing the respective pushnuts against a bias of the respective spring means to disengage the gear teeth from the respective notches to permit the respective rod portions of either or both of the roller frames to be indexed to different positions relative to one another for varying an angular orientation of the roller cover supports relative to one another.

9. The pipe painter assembly of claim 2 wherein there are twelve circumferentially spaced notches that are selectively disengageable by the respective gear teeth to permit turning of the respective rod portions in a same or different directions within the respective bores to allow the respective roller cover supports to be indexed in increments of 30° or more.

10. The pipe painter assembly of claim 2 wherein the respective shaft portions are substantially orthogonal to the respective rod portions.

11. The pipe painter assembly of claim 2 wherein the respective rod portions have oppositely angled portions intermediate the respective gear teeth and the respective shaft portions that extend in opposite directions relative to one another when the respective roller cover supports are in substantially parallel alignment with one another to alter a spacing between the roller cover supports when so oriented.

12. The pipe painter assembly of claim 11 wherein the oppositely angled portions of the respective shaft portions extend inwardly toward one another when the respective roller cover supports are in substantially parallel alignment with one another to reduce the spacing between the roller cover supports when so oriented.

13. The pipe painter assembly of claim 1 further comprising a cross member adjacent an inner end of the handle, the cross member having opposite end portions extending laterally outwardly beyond opposite sides of the handle containing the respective bores.

14. The pipe painter assembly of claim 13 wherein the respective bores in the opposite end portions of the cross member extend axially inwardly of the inner end of the handle.

15. The pipe painter assembly of claim 14 wherein an outer end of the handle comprises a hand grip having an axis substantially parallel to axes of the respective bores.

16. The pipe painter assembly of claim 15 wherein the hand grip contains a threaded socket having an axis substantially parallel to the axes of the respective bores.

17. The pipe painter assembly of claim 1 wherein paint roller covers are supported by the respective paint roller cover supports.

* * * * *